United States Patent [19]

Bassett

[11] Patent Number: 4,867,612

[45] Date of Patent: Sep. 19, 1989

[54] OFFSHORE PLATFORM JACKET TO PILE CONNECTOR

[76] Inventor: Max Bassett, 926 Coachlight Dr., #422, Houston, Tex. 77077

[21] Appl. No.: 147,976

[22] Filed: Jan. 25, 1988

[51] Int. Cl.[4] ..... E02B 17/02

[52] U.S. Cl. ..... 405/227; 405/199

[58] Field of Search ..... 405/195, 196, 198, 199, 405/203, 224, 227

[56] References Cited

U.S. PATENT DOCUMENTS

| | | | |
|---|---|---|---|
| 2,944,403 | 7/1960 | Smith | 405/199 |
| 4,269,543 | 5/1981 | Goldman et al. | 405/198 |
| 4,337,010 | 6/1982 | Sullaway et al. | 405/227 |
| 4,479,401 | 10/1984 | Korkut | 405/198 X |
| 4,497,592 | 2/1985 | Lawson | 405/227 X |

*Primary Examiner*—David H. Corbin

[57] ABSTRACT

Tubular jacket legs of an offshore platform used for petroleum recovery operations are secured to respective internally positioned cylindrical pilings which extend into the sea bed. Each of the jacket legs is mechanically connected to a piling by an arcuate gripping member and a plurality of piston assemblies circumferentially and axially spaced about the jacket leg. Each piston assembly includes a housing fixedly secured to the jacket leg at a preselected angle, a piston slidably movable within the housing, an end cap threadably secured to the housing for maintaining a radially directed force on the piston, and a pivot member at the end of the piston for applying a uniform force from the gripping member to the piling. The substantial force exerted by the piston assemblies structurally interconnects the platform to the pilings, and the annulus between each jacket leg and piling need not be grouted. The pistons may subsequently be retracted outwardly to release the gripping member from the piling and thus disconnect the leg from the piling, thereby resulting in substantial savings in the salvage of the platform.

22 Claims, 2 Drawing Sheets

OFFSHORE PLATFORM JACKET TO PILE CONNECTOR

FIELD OF THE INVENTION

The present invention relates to techniques for fixedly interconnecting a structural tubular member of an offshore structure with an internally positioned tubular member and, more particularly, to techniques for fixedly interconnecting a jacket leg of a subsea petroleum recovery platform to a cylindrical piling interior of a tubular platform jacket leg.

BACKGROUND OF THE INVENTION

The primary structural components of an offshore petroleum recovery installation are (1) the pilings which are driven into the sea bed to form the foundation for the structure, (2) the platform which acts as a template to structurally interconnect the pilings and provides support for various subsea equipment associated with the well, and (3) the decking which is supported above the water line on the main pilings. Those familiar with the design of offshore petroleum recovery structures recognize that the subsea platform typically consists of inclined main jacket legs, comparatively short satellite jacket legs, and cross braces which interconnect the legs to provide a unitary platform. The main pilings generally extend from above the water line through the respective main platform legs and into the sea bed, while satellite pilings typically extend from just above the shorter jacket legs into the sea bed. Significant static and dynamic axial, radial and rotational forces are transmitted from each piling to its surrounding leg, and from each leg to its interiorly positioned piling. The platform serves to transfer some of this stress load from the main pilings to the satellite pilings, and acts to more uniformly distribute the remaining load over each of the main pilings.

In order to provide the desired structural support between the pilings, it is essential that the platform legs be securely affixed to the respective piling within that leg. The desired structural connection is most commonly obtained by providing a pair of spaced inflatable members in the annulus between the platform leg and the piling, and then filling the annulus between the spaced inflatable members within concrete or other grouting material. Cured grouting in this annulus thus provides the necessary interconnection between the platform legs and each interiorly positioned piling to withstand the substantial axial, radial and rotational forces acting between a platform leg and a piling, and thus cooperates with the platform to provide the desired structural interconnection between the various pilings of the offshore petroleum recovery installation.

In spite of the widespread acceptance of the above-described grouting technique, this procedure has significant drawbacks. The cylindrical-shaped piling and external platform tubulars are rarely concentric, and it is thus difficult and expensive to ensure that grouting has adequately filled thinner annulus spacings between each platform leg and its eccentrically positioned piling. Most importantly, however, is the fact that a subsea platform cannot practically be separated from its pilings during subsequent salvage operations, i.e., when the economic life of the offshore wells serviced by the installation has been exhausted. While the pilings themselves are generally metallic tubulars which can be cut below the sea bed mud line, the platform cannot thereafter be practically refloated to the surface because of the substantial weight which the pilings and the grouting add to the platform. As a consequence, platforms secured to pilings by the above-described grouting technique are customarily cut up subsea, and individual components then retrieved to the surface. This subsea disassembly of the platform is not only extremely expensive, but also substantially destroys the value of the platform for subsequent use. Those skilled in the art recognize that millions of dollars are lost annually because subsea petroleum recovery platforms grouted to the pilings cannot be practically recovered.

Although the above-described grouting technique is used worldwide in most petroleum recovery installations, platform legs have been mechanically connected to pilings by expanding the piling radially outward into fixed engagement with the platform legs. Equipment and techniques for accomplishing this radial expansion of the pilings are marketed under the trade names "Lynes Corrigator" and "Hydrolock". This radial expansion technique has not been widely accepted, however, both because of its expense and because the process of forming the mechanical interconnection between the piling and the platform leg inherently reduces the structural integrity of the piling. Moreover, this technique generally does not allow the platform as a unitary structure to be refloated to the surface, since the substantial weight of the interconnected pilings renders floatation impracticle, and since the formed interconnection between the pilings and the platform legs cannot be practically disengaged.

The disadvantages of the prior art are overcome by the present invention, and improved techniques are hereinafter disclosed for connecting jacket legs of an offshore platform to interiorly positioned cylindrical pilings.

SUMMARY OF THE INVENTION

Circumferentially spaced and axially elongate arcuate gripping members are provided in the annulus between a platform jacket leg and the piling within that leg. A plurality of piston assemblies each secured to the platform jacket leg are provided for exerting a radially inward force on the gripping member to provide a mechanical connection between the platform jacket leg and the piling sufficient to transmit the substantial axial, radial and rotational forces between these components.

Each gripping member and its associated piston assemblies are mounted within a leg can portion of the platform jacket leg having an interior diameter greater than the interior diameter of the leg, so that the retracted gripping member may be positioned within the recess of the can and need not extend radially inward beyond the interior surface of the leg above or below the can. The axis of each piston assembly is preferably not normal to the axis of the platform leg, but is fixedly inclined upward or downward, or is angled horizontally or offset to avoid passing through the axis of the platform leg. This predetermined inclination, angling or offset substantially increases the force which may be reliably transmitted between the piling and its associated jacket leg by each piston assembly. The desired inclination of each piston assembly will be determined prior to lowering the platform to the sea bed, and the number and inclination of the piston assemblies will be selected for each installation to safely transmit the maximum anticipated axial and rotational forces acting in a certain direction from the piling to the jacket leg, or from the jacket leg to the piling. A pivot member between the piston and the gripping member allows the piston to move inward along the axis of the piston assembly, while simultaneously enabling the arcuate gripping member to conform to the exterior surface of a piling eccentrically positioned within the jacket leg.

In one embodiment of the present invention, each piston assembly includes a bell housing with its expanded portion welded at a predetermined angle to the can. The piston is slidably movable along the axis of the piston assembly, with a universal joint having a diameter substantially greater than the piston being positioned between the gripping member and the piston. When the piston is retracted, the universal joint is housed within the expanded portion of the bell housing, and the exterior surface of the arcuate gripping member is adjacent the interior surface of the can. A tapered bearing assembly is provided at the opposite end of the piston for engagement with a housing end cap. The end cap is threaded to the bell housing, so that torqued rotation of the end cap relative to the piston housing is translated to a substantial axially-directed force on the piston, thereby bringing the gripping member into engagement with the piling and interconnecting the piling and platform leg.

According to the technique of the present invention, the piston assemblies and associated gripping members mounted within a leg can are positioned at a selected location along the axis of each platform leg. The platform is then lowered to the sea bed, with the gripping members in their retracted position. Each of the main and satellite pilings is then passed through a respective platform leg, and is driven into the sea bed in conventional fashion. Once each piling is driven to its desired depth, the plurality of piston assemblies may be extended to bring the gripping members into engagement with the piling. Radially inward movement of each piston within its piston assembly may occur as a result of threaded engagement of the end cap to the housing, or may result from hydraulic pressure being applied to the end of the sealed piston.

If it should become desirable, a particular platform leg may be easily regripped to its respective piling by retracting the pistons and gripping members which form the mechanical interconnection, and then reactivating the connection in the above-described manner. When a platform is to be retrieved to the surface for salvage after the wells serviced by the platform have been economically exhausted, each piling may first be cut below the mud line. The piston assemblies and gripping members may then be retracted, so that each piling can be pulled through its platform leg to the surface. The unitary platform may then be refloated to the surface, since it is no longer weighted by the pilings. The technique as described herein thus results in a substantial savings in the expense associated with recovering the platform, and enables the platform to be economically reused at another petroleum well site installation.

It is thus a feature of the invention to provide a technique for economically connecting and selectively disconnecting a platform leg with an interiorly positioned piling.

It is also a feature of the invention to provide connectors for mechanically interconnecting a platform and pilings which enables the platform to be safely retrieved to the surface as a substantially unitary assembly.

Still another feature of the invention is a practical and cost effective mechanical connector between a piling and an eccentrically positioned platform leg.

Yet another feature of the present invention is a connector between a platform leg and a piling which does not adversely affect the structural integrity of the piling.

These and further features, objects, and advantages of the present invention will become apparent from the following detailed description, wherein reference is made to the figures in the accompanying drawings.

DETAILED DESCRIPTION OF PREFERRED EMBODIMENTS

The connectors of the present invention are used to structurally interconnect an offshore platform to cylindrical pilings each positioned interiorly of a platform tubular jacket leg. The connectors are thus utilized in a subsea environment which demands high reliability. The techniques of the present invention enable the platform to be economically secured to the piling, while also permitting the release of the jacket legs from the piling and, if desired, the subsequent structural reconnection of a jacket leg and piling. Substantial savings can be realized when utilizing the connectors of the present invention, since the subsea platform can be retrieved to the surface for reuse as a unitary structure.

Figure 1:
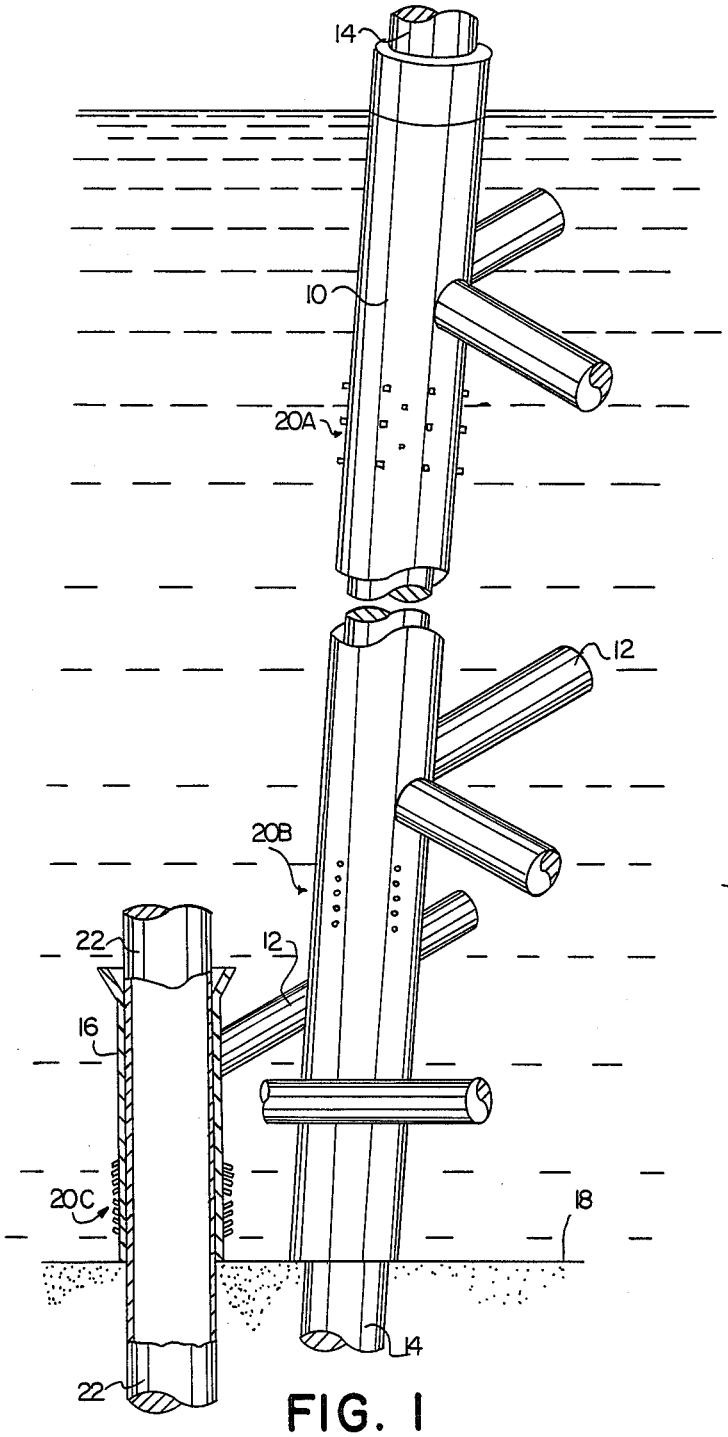
FIG. 1 is a simplified pictorial view, partially in cross section, of a portion of a subsea petroleum recovery platform positioned over a main piling and a satellite piling.

Referring now to FIG. 1, a main jacket leg 10 and a satellite jacket leg 16 of a conventional subsea petroleum recovery platform are generally depicted. Those skilled in the art recognize that the platform typically includes at least three substantially vertical main legs which are generally inclined to increase structural integrity, and a plurality of substantially vertical satellite jacket legs 16 generally positioned about the main jacket legs. The main jacket legs 10 and the satellite jacket legs 16 are typically interconnected by welding or bolted flanges to form a unitary offshore platform.

With the platform resting on the floor of the ocean, each piling is lowered in telescoping fashion over its respective platform leg. Each of the pilings 14, 22 is then pounded into the sea bed in conventional fashion for forming the foundation of the offshore structure. In their final position, each of the main pilings 14 generally extends from the sea bed to above the surface of the water, thereby allowing offshore decking (not shown) to be subsequently placed over the main pilings. The satellite pilings 22 typically extend upward from the sea bed only slightly above the relatively short jacket leg 16. The platform thus acts as a template to interconnect the various main piling and satellite pilings, so that the significant forces acting between the pilings and platform can be more uniformly distributed.

The connectors of the present invention include a gripping member and a multitude of piston assemblies discussed in detail subsequently. For the present, however, it should be understood that the piston assemblies are typically arranged in rows and/or columns about the perimeter of a can portion of the main jacket legs and/or satellite jacket legs. A staggered row arrangement 20A of piston assemblies is shown in FIG. 1 for securing main jacket leg 10 to piling 14. Rows of vertically aligned piston assemblies are shown in arrangement 20B which also serve to secure the main jacket leg 10 to the piling 14. An arrangement 20C of the piston assemblies is depicted in FIG. 1 for interconnecting the satellite piling 22 and the satellite jacket leg 16. It should be understood that the number and arrangement of the piston assemblies about the can portion of the jacket legs will depend upon the particular conditions of the each offshore installation. One installation may include four axially spaced cans with from four to thirty piston assemblies mounted to each can for interconnecting a main jacket leg to a main piling. In another typical installation, three axially spaced cans each with a plurality of piston assembies may be used for interconnecting a main jacket leg to a main piling, with two similar additional cans being used to interconnect an adjacent satellite pilings to its jacket leg. Thus the axial spacing of the cans along the jacket leg, and the number and spacing of the piston assemblies about each can, will depend upon the anticipated or assumed forces to be transmitted between the jacket leg and the piling. This determination must be made prior to lowering the platform on to the sea bed since, as explained subsequently, each of the piston assemblies is fixedly secured to a sleeve-shaped can at a preselected angle.

Figure 2:
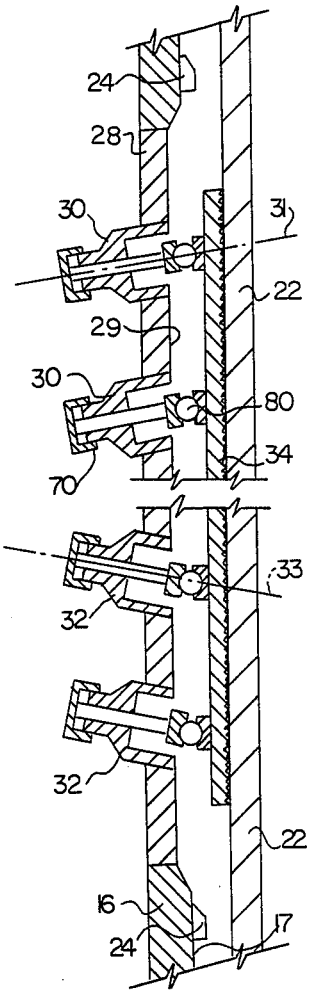
FIG. 2 is a cross sectional view of a portion of a of the satellite piling and interconnected platform jacket leg shown in FIG. 1.

A portion of a suitable connector according to the present invention is shown in greater detail in FIG. 2. The satellite jacket leg 16 is secured to the tubular piling 22 by a plurality of upwardly inclined piston assemblies 30 and a plurality of downwardly inclined piston assemblies 32 each affixed by welding to a sleeve-shaped leg can 28. Each of the piston assemblies exerts a substantial radial inward force on the elongate, arcuately shaped gripping member 34, which is shown in FIG. 2 in fixed engagement with the outer wall of the piling 22. A plurality of piston assemblies 30 may thus be arranged circumferentially about the jacket leg 16 in substantially horizontal rows, and several rows of piston assemblies 30 may be provided on a single leg can 28. Similarly, numerous downwardly projecting piston assemblies 32 are arranged in rows and columns about the leg can 28.

The metallic sleeve-shaped can 28 is weldably secured to upper and lower lengths of conventional jacket leg 16. The cylindrical inner surface 29 of leg can 28 has a radius greater than the radius of the internal surface 17 of the jacket legs 16, with this radius difference preferably being equal to or greater than the thickness of the gripping member 34. When the gripping member 34 is in its retracted position, it is thus in engagement with inner surface 29 and need not extend radially outward beyond surface 17 toward piling 22. Guides 24 weldably secured to leg 16 ensure that each piling can be safely passed through its leg and driven into the sea bed piling 22 without damaging the retracted gripping members. The outer cylindrical surface of the leg can 28 may have a diameter identical to the diameter of the leg can 16, as shown in FIG. 2. If additional structural strength for the leg can 28 is desired, the thickness of the can may be increased so that its outer surface was radially outward of the leg 16.

Significant forces directed along the axis of the jacket leg are typically transmitted between the jacket leg 16 and the piling 22. Those forces include, for example, much of the weight of the offshore platform and equipment normally located thereon for petroleum recovery operations. According to the present invention, each of a plurality of the piston assemblies 30 is inclined upwardly, so that the central axis 31 of each piston assembly 30 passes through or closely adjacent to the central axis of the can 28 (and thus approximately the central axis of the leg 16) but is inclined at an angle of, for example, 10° from a radial plane perpendicular to the central axis of the can. Similarly, a central axis 33 of each of a plurality of downwardly projecting piston assemblies 32 passes through the axis of the can 28, and is inclined downwardly from the radial plane at a 10° angle. (This inclination would thus be 10° from the horizontal if the axis of jacket leg and thus the can were truly vertical rather than also being inclined.)

This feature of the present invention allows the combination of piston assemblies 30 and 32 to reliably transmit a substantial axially-directed force between the leg 16 and the piling 22 in either the upward or downward directions. The upwardly inclined piston assemblies 30 are thus inclined at a preselected angle to transmit an axially directed upward force from the leg 16 to the piling 22 (or similarly to transmit an axially-directed downward force from the piling 22 to the leg 16). On the other hand, the downwardly inclined piston assemblies 30 are each inclined at a predetermined angle to transmit an axially-directed downward force from the leg 16 to the piling 22. Thus while the preselected inclined angle of each of the piston assemblies 30 and 32 will depend upon the particular conditions of the offshore installation, it is a feature the present invention that a plurality of upwardly inclined and a plurality of downwardly inclined piston assemblies be provided for each of the connectors of the present invention.

In a preferred embodiment, the connector includes an arcuately shaped elongate gripping member 34 which is held in secured engagement to the piling by a plurality of piston assemblies. As shown in FIG. 2, each of the plurality of upwardly inclined piston assemblies 30 and each of the downwardly inclined piston assemblies 32 thus act upon the same gripping member 34. By providing an elongate gripping member for cooperation with numerous piston assemblies within the same leg can, substantially uniform forces can be applied to a greater aerial portion of the piston assembly than is likely if each piston assembly were provided with its own gripping member. Also, the cost of the connector is reduced, and potential problems associated with interference between multiple gripping members are avoided.

FIG. 2 also depicts a universal joint 80 between each piston 70 and the gripping member 34. Universal joint 80 ensures that area pressure will be applied to the gripping member 34 by each piston assembly regardless of the inclination, angle, or offset of each piston assembly. If a planar face of the piston assembly in engagement with the gripping member 34 were fixed with respect to the axis of the piston assembly at an inclination equal to the predetermined angle which was selected for fixing the piston assembly to the leg can 28, the piston assembly would apply an area force to the gripping member in engagement with the piling if the piling and leg can were concentric. Nevertheless, a universal joint in each piston assembly is preferred according to the present invention to ensure area engagement of the gripping member with the piling, since the piling axis may be slightly inclined with respect to the axis of the leg can, and even a slight variation would otherwise result in uneven area distribution of forces on the piling.

Figure 3:
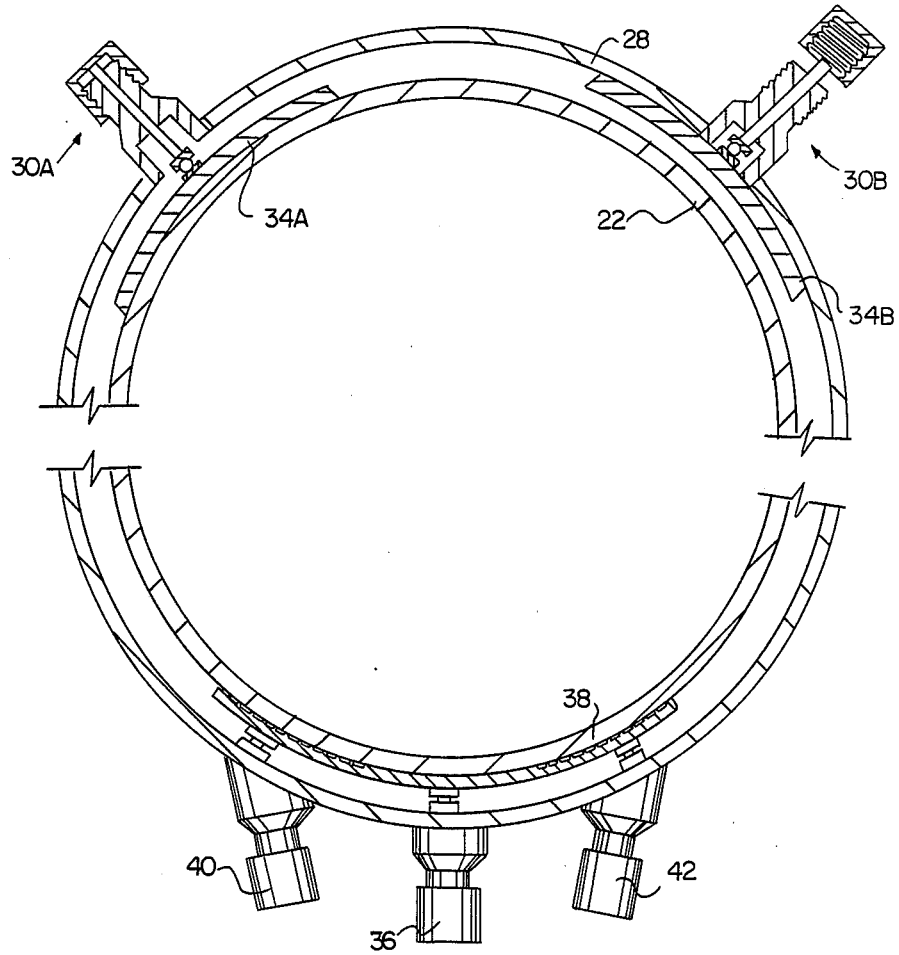
FIG. 3 is a cross-sectional view of a platform jacket leg and piling, illustrating the circumferentially spaced arrangement of the gripping members.

Suitable arcuately shaped gripping members 34A and 34B are shown in FIG. 3. It should be understood that two or more gripping members will preferably be provided within the same leg can, with the gripping members being uniformly spaced about the perimeter of the can. The center line of the gripping members 34A and 34B are spaced at an angle of approximately 90°, and accordingly four substantially identical gripping members may be spaced about the perimeter of the can 28. (The corresponding gripping members 34C and 34D and their associated piston assemblies 30C and 30D are not depicted in FIG. 3.) Piston assembly 30A is shown in its extended position, so that gripping member 34A is in secured engagement with piling 22. Piston assembly 34B is depicted in its retracted position, so that gripping member 34B is out of engagement with piling 22 and its adjoining leg can 28.

FIG. 3 also depicts another gripping member 38 held in engagement with piling 22 by piston assemblies 36, 40 and 42. Although provided within the same leg can as the gripping members 34A and 34B, piston assemblies 36, 40 and 42 may be axially spaced from piston assemblies 34A and 34B, and it should thus be understood that assemblies 36, 40 and 42 are positioned below assemblies 30A and 30B. Although not shown in FIG. 3, it should also be understood that an opposite gripping member and corresponding number of piston assemblies are preferably provided radially opposite gripping member 38, so that uniform gripping of the piling is obtained. I other words, a substantial radial force applied to the piling by each of the piston assemblies is preferably resisted by a radial oppositely positioned gripping member subjected to the same radial force and positioned on the radially opposite side of the can, or by a pair of gripping members which together produce a radial force in the opposite direction.

The central axis of piston assembly 36 passes through and is perpendicular to the axis of the leg can 28, and the assembly 36 is thus intended to exert a purely radially directed force on the piling. Thus while the piston assemblies 30 and 32 exert a force on the piling with a substantial radial component plus an axially directed component, and are thus provided for transmitting an axially directed force between the leg 16 and piling 22, piston assemblies 36 are intended to transmit a substantially horizontal or radial force between these components.

The central axis of piston assembly 40 is inclined outwardly with the axis of piston assembly 36, and is spaced therefrom so that the axis of piston assembly 40 is substantially spaced from the axis of the leg can 28. Piston assembly 40 is provided to transmit a counterclockwise rotational force from leg 28 to piling 22, or to transmit a clockwise rotational force from piling 22 to leg 28. The central axis of piston assembly 42 is similarly inclined outwardly with respect to the central axis of piston assembly 36, and is spaced from and on the opposite side of the central axis of leg can 28. Thus piston assembly 42 is provided for reliably transmitting a clockwise rotational force from leg 28 to the piling 22.

Each of the piston assemblies 40 and 42 may also be angled with respect to the center line of the piston assembly 36 to vary the rotational force which may be reliably transmitted by that piston assembly. If the piston assemblies 40 and 42 were angled inwardly so their central lines were closer to the axis of the leg can, less rotational force could be transmitted through that piston assembly, although this arrangement may facilitate attachment of the piston assembly to the leg can and reduce manufacturing costs. On the other hand, if the piston assemblies 40 and 42 were angled further outwardly from the center line of the leg can, more rotational force between the piling 22 and the leg 28 could be reliably transmitted by the piston assemblies. FIG. 3 also depicts that the universal joint associated with each piston assembly results in force being applied to the gripping member over an area, regardless of the offset or angle of the piston assemblies 40 and 42.

It should thus be understood that the platform leg to piling connector of the present invention may include one or more leg cans, each having a plurality of arcuate shaped gripping members spaced circumferentially about the leg can, and a multiplicity of piston assemblies for bringing the gripping members into secured engagement with the piling. A first plurality of the piston assemblies are fixed to a leg can at a preselected upwardly inclined angle, and a second plurality of piston assemblies are fixed to the same or another leg can at a downwardly inclined angle. Each of the piston assemblies will exert a substantial radial force on the piling, but will also be able to reliably transmit a substantially axially directed force between the platform leg and the piling, thereby preventing vertical movement of the platform with respect to a leg.

The same or another leg can may also be provided with a third plurality of piston assemblies, with the axis of each of the third plurality of piston assemblies being spaced on one side of the axis of the leg can for transmitting a clockwise rotational force between the platform leg and the piling. A fourth plurality of piston assemblies, each having its axis spaced on the other side of the central axis of the leg can, are provided for transmitting a counterclockwise rotational force between the platform leg and the piling. The third and fourth plurality of piston assemblies thus prevent rotational movement between the platform leg and the piling. Finally, the same or another leg can may be provided with a fifth plurality of piston assemblies, with each of the fifth plurality of piston assemblies having its axis passing through and being substantially perpendicular to the axis of the leg can for transmitting primarily a horizontal or radial force between these components.

The function of two or more of the piston assemblies described above may be combined. For example, an upwardly inclined piston assembly which also has its axis spaced from the center line of the leg can could achieve the benefits of one of the first and one of the third plurality of piston assemblies, while another downwardly inclined piston assembly having its axis spaced on the opposite side of the leg can could function in a manner similar to one of the second and one of the fourth piston assemblies. Nevertheless, it is a feature of the present invention that each of the piston assemblies be intended to primarily transmit a force between the platform leg and the piling having primarily one vectorial component. Most importantly, the piston assemblies are not provided at a mere random orientation about the periphery of the platform leg, but rather are each fixed to the leg can 28 at a preselected angle for cooperating with other piston assemblies to transmit an assumed force in a certain vectorial direction between the platform leg and the piling.

Figure 4:
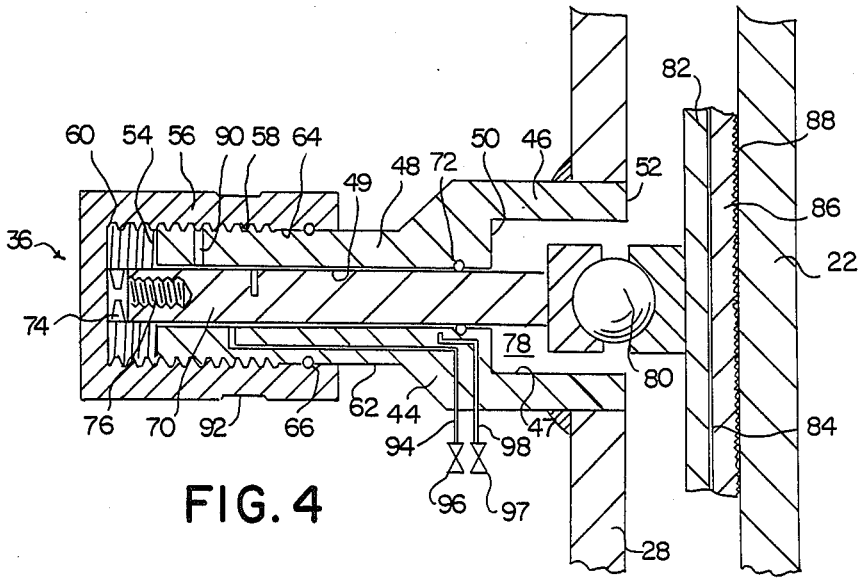
FIG. 4 is a detailed cross sectional view of a preferred piston assembly and a portion of a gripping member in engagement with a piling.

The details of a suitable piston assembly 36 are shown in FIG. 4. Although a vast majority of the piston assemblies in a leg can 28 do not have their axes perpendicular to and passing through the center line of the leg can, each of the piston assemblies are substantially identical to that depicted in FIG. 4. The housing of the piston assembly affixed to the leg can 28 may be altered from that shown in FIG. 4 to better accommodate the inclined, angled, or offset orientation of each piston assembly weldably affixed to the leg can.

Piston assembly 36 includes a bell housing 44 having an expanded end 46 for weldably securing to the leg can 28, and a free end 48. A cylindrical passageway 49 in the end 48 is adapted for slidably receiving piston 70, while a cylindrical passageway 47 in the end 46 is intended for receiving the cylindrical-shaped universal joint 80. A stop surface 50 between the passageways 47 and 49 acts to limit retractive movement of the piston 70 by engagement with universal joint 80. The end surface 52 of the housing 44 does not extend radially inward of the inner surface of the leg can 28, so that the gripping member may be brought into engagement with leg can 28 when in its retracted position.

The free or cantilevered end 48 of the housing is threaded so that end cap 56 may be attached thereto by threads 58. The planar surface 60 of end cap 56 is in engagement with tapered bearing assembly 74 which is removably secured to the end of piston 70. Torqued rotation of the end cap 56 relative to the housing 44 thus acts through bearing assembly 74 to produce a substantial force along the central axis of the piston assembly to drive the piston 70 inward and thus bring the gripping member into engagement with the piling. The threads 78 may be coated with Teflon or other suitable material to reduce friction between the end cap and the housing 44. Low friction between the end cap and the piston is obtained by utilizing bearing assembly 74, which allows the end cap to freely rotate, while movement of the piston 70 is limited by housing 44 to the direction along the central axis of the piston.

The platform leg and thus the leg can may be eccentrically located about the piling 22. In order to allow for variations in the thickness in the annulus between the piling and the platform leg, it may be seen from FIG. 4 that the planar surface 60 of the end cap is normally substantially spaced from the end 54 of the housing 44, although the gripping member is shown in engagement with the piling 22. In other words, the spacing between surfaces 60 and 54 would allow continued torqued rotation of the end cap relative to the housing sufficient to bring the gripping member into engagement with the piling 22 for the maximum possible annulus spacing between the leg can 28 and piling 22.

With the end cap 56 threaded onto the housing 44, the end of the piston 44 opposite the universal joint 80 may be sealed from the environment by seals 66 and 72. Seal 66 maintains sealed engagement between the cylindrical inner surface 64 of the end cap and the cylindrical outer surface 62 of the housing regardless of the threaded position of the end cap on the housing. The seal 72 maintains sealed engagement between the cylindrical inner surface 49 of the housing and the outer cylindrical surface of the piston 70.

The piston 70 may also be moved to bring the gripping member into engagement with the piling by fluid pressure. If valve 96 is opened, fluid pressure may be applied to the piston through flow line 94 in the housing 44. Since the opposite end of the piston assembly is subjected to the constant force of sea water pressure, increased fluid pressure in the line 94 will drive the piston inwardly. Fluid may be circulated through the piston assembly during this process by passing out discharge line 98 having a regulatable flow valve 97 attached thereto.

The universal joint 80 is provided with a large diameter ball for transmission of high forces. The universal joint 80 thus extends radially outwardly from the piston surface with respect to the piston axis. Nevertheless, the universal joint has a diameter substantially less than the diameter of cylindrical surface 47, since it is intended for the universal joint to be easily retracted into the cavity 78 even if the universal joint of an inclined or angled piston assembly were to become locked or frozen in the position as shown in FIG. 2 or 3.

A portion of the gripping member is also shown in greater detail in FIG. 4. The gripping member preferably includes a metallic arcuate-shaped outer member 82 movably secured to the universal joint 80, a metallic arcuate-shaped inner member 86 having teeth 88 thereon for biting engagement with the liner 22, and a relatively thin plastic layer 84 sandwiched between 82 and 86. Layer 84, which may be a laminated elastomeric material formed either on 82 or 86, provides some resiliency to the gripping member so that the gripping member better grips the piling 22 even when the piling is not perfectly cylindrical, or when the diameter of the piling does not conform exactly to the arcuate shape of the gripping member. Thus while the universal joint 80 ensures that a planar force will always be applied to the gripping member by each piston assembly regardless of its inclination, angle or offset, the elastomeric layer 84 is provided to better enable the arcuate inner member 86 to flex so that the teeth 88 will be uniformly in biting engagement with the piling.

The surface of the gripping member adjacent each piston assembly will preferably have gripping teeth inclined to assist in the transmission of the certain vectorial force between the platform leg and the piling. In other words, that portion of the gripping member 34 urged into the piling by the upwardly inclined piston assemblies 30 will preferably include upwardly inclined rows of teeth, while that portion of the gripping member adjacent the downwardly inclined piston assemblies 32 will include downwardly inclined teeth (see FIG. 2). Similarly, that portion of the gripping member adjacent the piston assemblies 40 will preferably include vertical columns of teeth angled in a direction clockwise with respect to the central axis of the piling, while that portion of the gripping member adjacent piston assemblies 42 will preferably include columns of teeth angled in the opposite direction (see FIG. 3).

According to the method of the present invention, a preselected number of leg cans are provided at selected intervals along the length of the main platform legs and/or the satellite platform legs. Each leg can includes a plurality of gripping members and a plurality of piston assemblies as described herein, so that the piston assemblies are each fixed to the leg can at a preselected angle for transmitting the necessary force between the platform leg and the piling. Piston assemblies may arranged in rows and columns about the leg can, and the leg can may be axially spaced adjacent a cross brace 12 to increase structural integrity.

The unitary platform will be lowered (controllably sunk) to the sea bed floor, with the piston assemblies and the gripping members in their retracted position. Gripping members thus do not extend radially inward of the adjacent platform leg interior surfaces, and accordingly will not interfere with the lowering of the piling through the platform leg. Each of the pistons 70 may be shear pinned to the housing 44, so as to retain the gripping members in this retracted position during the pile driving operation (see shear pin 90 in FIG. 4).

Once the piling legs have been properly driven into the sea bed, a diver, robot, or other conventional means may be utilized to rotate the end cap 56, thereby extending each of the pistons 70 and driving the gripping members into engagement with the liner. The pistons for each of the multiplicity of piston assemblies may be moved partially inward in staged sequence, so that the gripping member having multiple pistons attached hereto is uniformly brought into engagement with the piling. To assist in torqued engagement of the end cap to each of the housings 44, each end cap may be provided with planar sides 92 for receiving a conventional tool.

Each of the piston assemblies within the leg can may alternatively be actuated to move the gripping members into engagement with the piling by supplying a hydraulic pressure to each of the piston assemblies through flow lines 94 and 98. According to one technique, fluid pressure applied to each of the piston assemblies is used to bring and maintain the gripping members into secured engagement with the piling, thereby obviating the need for the end cap to be threadably secured to the body 44. According to another method, fluid pressure is utilized to bring the gripping members uniformly into engagement with the piling, although this high fluid pressure is not maintained within the piston assembly over a long period of time. Rather, fluid pressure is utilized to move the gripping members inward into biting engagement with the piling, and the end caps are then rotated with respect to each piston assembly housing to maintain the necessary pressure on each of the pistons 44 after the fluid pressure is relieved. In this later case, fluid will be vented through line 98 as the end cap is rotated into engagement with the piston.

The plurality of circumferentially spaced arcuate gripping members and piston assemblies of the present invention also allow the platform leg to be more concentrically positioned about the piling. For example, if three circumferentially spaced gripping members A, B, and C are positioned at the 2:00, 6:00 and 10:00 positions, respectively, and it is known or presumed that the annulus between the piling and the platform leg is more restricted at the 2:00 position, the piston assemblies associated with gripping member A may first be partially extended so that the vertical axes of the piling and platform leg move closer together. Thus as each of the piston assemblies is activated in staggered sequence until the end caps have been torqued to their predetermined extent, the effect of successively increasing the end cap torque on the pistons associated with gripping member A before applying the same torque to the piston assemblies associated with gripping members B and C will be to establish a more uniformly thick annulus between the piling and the platform leg.

It may be desirable during the life of the offshore installation to disconnect and reconnect one or more pilings from its respective platform leg. This may be accomplished by unthreading each end cap of the piston assemblies, thereby drawing each universal joint 80 into its receiving cavity 78 and bringing the gripping member into engagement with the leg can 28. In the event that a piston should become corroded or otherwise lodged in the locked position, the end cap 56 may be completely removed, the bearing assembly 74 removed from the end of the piston 44, and a conventional tool inserted into the threaded cavity 76 in the piston. An extracting force may be easily applied to the tool in conventional manner to pull the piston to its retracted position.

After the useful life of the offshore installation has been exhausted, it is generally desirable to retrieve the platform. According to the present invention, the platform may be easily retrieved as a unitary structure by cutting the pilings below the mud line, then disconnecting each platform leg/piling interconnection in the manner described above. The piling may then be pulled to the surface through the platform legs. With the weight of the pilings off the platform, the unitary platform may then be floated to the surface using conventional technology. The platform can thus be easily salvaged as a unitary structure, thereby resulting in a significant saving compared to conventional salvage operations wherein the platform is disassembled subsea.

Those skilled in the art would appreciate that various modifications can be made without departing from the spirit of the invention. A piston-like member similar to the vertical support of a conventional automobile jack may be utilized for applying force to the gripping member, so that the piston may be jacked radially inward by the repeated engagement and disengagement of the latch dogs. Pilings need not be tubular, and platform legs may be secured to solid cylindrical pilings utilizing the connector of the present invention. Also, a length of each tubular piling in the vicinity of each of the connectors may be provided with a substantially reduced interior diameter, so that the increased wall thickness of the piling can better withstand the high forces applied by the piston assemblies without risk of collapsing the piling.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A subsea connector for mechanically interconnecting a tubular jacket leg of a petroleum recovery platform and a cylindrical piling positioned within the jacket leg and extending into the sea bed, the platform structurally interconnecting a plurality of pilings each passed through a respective jacket leg and into the sea bed, the subsea connector comprising:

a sleeve-shaped leg can having a substantially vertical central axis and structurally interconnecting axially spaced lengths of the tubular jacket leg at each end of the leg can, the leg can having an interior surface with a leg can radius greater than the jacket leg radius of the interior surface of spaced lengths of the tubular jacket leg secured to each end of the leg can;

a plurality of arcuately-shaped gripping members each movably mounted within the leg can for positioning in an annulus between the cylindrical piling and the leg can;

a multiplicity of piston assemblies each fixedly secured to the leg can and connected to one of the plurality of the gripping member, each piston assembly having a piston movable along a radially inward-directed piston axis for moving each of the plurality of gripping members between a retracted position and an extended position, each piston assembly further including a swivel joint between an end of the piston and the connected one of the plurality of gripping members for allowing the gripping member to swivel about the axis of the piston assembly to uniformly engage the cylindrical piling;

each of a first plurality of the multiplicity of piston assemblies being affixed to the leg can at a first predetermined angle such that its radially inward-directed piston axis is projecting toward one end of the leg can for transmitting a substantially vertical first force between the tubular jacket leg and the piling; and each of a second plurality of the multiplicity of piston assemblies being affixed to the leg can at a second predetermined angle such that its radially inward-directed piston axis is projecting toward an opposite end of the leg can for transmitting a substantially vertical second force between the tubular jacket leg and the piling which is vectorially opposite the first force.

2. The subsea connector as defined in claim 1, further comprising:

each of the arcuately-shaped gripping members having a thickness less than the spacing between the leg can radius and the jacket leg radius, such that each gripping member does not extend radially inward of the jacket leg radius in its retracted position.

3. The subsea connector as defined in claim 1, further comprising:

each of a third plurality of the multiplicity of piston assemblies being affixed to the leg can such that its radially inward-directed piston axis is projecting on one side of the central axis of the leg can for transmitting a third rotational force between the tubular jacket leg and the piling; and each of a fourth plurality of the multiplicity of piston assemblies being affixed to the leg can such that its radially inward-directed piston axis is projecting toward an opposite side of the axis of the leg can for transmitting a fourth rotational force between the tubular jacket leg and the piling opposite the third force.

4. The subsea connector as defined in claim 1, wherein said multiplicity of piston assemblies are symmetrically arranged in rows and columns about a perimeter of the leg can.

5. The subsea connector as defined in claim 1, each of the piston assemblies further comprising:

a bell housing having a free end defining an interior cavity for slidably receiving the piston therein and having an opposing end affixed to the leg can;

the swivel joint extending radially outward of the piston with respect to the piston axis; and the opposing end of the bell housing defining an expanded diameter cavity for receiving the swivel joint such that substantially the entirety of the swivel joint is housed within the expanded diameter cavity when the connected one of the plurality of gripping members is in its retracted position.

6. The subsea connector as defined in claim 1, each of the piston assemblies further comprising:

a housing having a free end defining an interior cavity for slidably receiving the piston therein and having an opposing end affixed to the leg can;

an end cap threadably secured to the free end of the bell housing such that torqued rotation of the end cap on the housing exerts a substantial force on the piston along the piston axis.

7. The subsea connector as defined in claim 6, each of the piston assemblies further comprising:

a bearing assembly between an interior surface of the end cap and the piston for low frictional engagement between the rotating end cap and the piston.

8. The subsea connector as defined in claim 1, wherein each of the gripping members comprise:

an outer metallic arcuate-shaped pusher member;

an inner metallic arcuate-shaped pile biting member; and an elastomeric arcuate-shaped pad spaced between the outer metallic pusher member and the inner metallic biting member.

9. A connector for mechanically interconnecting a tubular jacket leg of a petroleum recovery platform and a piling positioned within the jacket leg and extending into the sea bed, the connector comprising:

a tubular-shaped support means having a central axis for structurally interconnecting axially spaced lengths of the tubular jacket leg at each end of the support means, the support means having an interior surface with a first radius greater than a second radius of the spaced lengths of the tubular jacket leg securable to each end of the support means;

a plurality of arcuately-shaped gripping means each movably mounted within the support means for positioning in an annulus between the cylindrical piling and the support means, each of the arcuately-shaped gripping means having a thickness less than the spacing between the first radius and the second radius;

a multiplicity of force applying means each fixedly secured to the support means and connected to one of the plurality of gripping means, each force applying means including (a) housing means for rigidly interconnecting to the support means, (b) piston-like means movable within the housing each of the plurality of gripping means between a retracted position and an extended position, (c) a swivel joint means between an end of the piston-like means and the connected one of the gripping means for allowing the gripping means to swivel about the piston axis for planar engagement of the arcuately-shaped gripping means and the piling and (d) force generating means for acting on the piston-like means and moving piston-like means inwardly along the piston axis;

each of a first plurality of the multiplicity of force applying means being affixed to the support means at a first predetermined angle such that its piston axis is projecting toward one end of the support means for transmitting a substantial axially-directed first force between the tubular jacket leg and the piling; and each of a second plurality of the multiplicity of force applying means being affixed to the leg support at a second predetermined angle such that its piston axis is projecting toward an opposite end of the support means for transmitting a substantial axially-directed second force between the tubular jacket leg and the piling which is vectorially opposite the first force.

10. The connector as defined in claim 9, further comprising:

each of a third plurality of the multiplicity of force applying means being affixed to the support means such that its piston axis is projecting on one side of the central axis of the support means for transmitting a third rotational force between the tubular jacket leg and the piling; and each of a fourth plurality of the multiplicity of force applying means being affixed to the support means such that its piston axis is projecting toward an opposite side of the central axis of the support means for transmitting a fourth rotation of force between the tubular jacket leg and the piling opposite the third force.

11. The connector as defined in claim 9, wherein each of the force applying means further comprising:

the housing means is bell housing means having a free end defining an interior cavity for slidably receiving the piston-like means therein and having an opposing end affixed to the support means;

the swivel joint means extending radially outward of the piston-like means with respect to the piston axis; and the opposing end of the bell housing means defining an expanded diameter cavity for receiving the swivel joint means, such that substantially the entirety of the swivel joint means is housed within the expanded diameter cavity when the gripping means is in its retracted position.

12. The connector as defined in claim 9, wherein each of the force applying means further comprises:

the housing means having a free end defining an interior cavity for slidably receiving the piston-like means therein and having an opposing end affixed to the support means;

the force generating means is end cap means threadably secured to the free end of the housing means such that torqued rotation of the end cap means to the housing means exerts a substantial force on the piston-like means along the piston axis.

13. The connector as defined in claim 12, wherein each of the force applying means further comprises:

bearing assembly means between an interior surface of the end cap means and the piston-like means for low frictional engagement between the rotating end cap means and the piston-like means.

14. A method of forming a mechanical connection between a tubular jacket leg of a petroleum recovery platform and a cylindrical piling positioned within the tubular jacket leg and extending into the sea bed, the platform structurally interconnecting a plurality of pilings which support the platform, surface decking, and petroleum recovery equipment located on the platform and surface decking, the method comprising:

providing a sleeve-shaped leg can having a substantially vertical central axis and structurally interconnecting axially spaced lengths of the tubular jacket leg at each end of the leg can, the leg can having an interior surface with a leg can radius greater than the jacket leg radius of the spaced lengths of the tubular jacket leg secured to either end of the leg can;

fixedly securing each of a multiplicity of piston assemblies to the leg can, each piston assembly having a piston movable along a radially inward-directed axis between a retracted position and an extended position;

pivotably interconnecting each of the multiplicity of piston assemblies with one of a plurality of arcuately-shaped gripping members each housed within the leg can for planar engagement of each of the gripping members and the cylindrical piling;

each of a first plurality of the multiplicity of piston assemblies being fixed to the leg can at a first predetermined angle such that its radially inward-directed piston axis is projecting toward one end of the leg can for transmitting a substantial axially-directed first force between the tubular jacket leg and the piling;

each of a second plurality of the multiplicity of piston assemblies being fixed to the leg can at a second predetermined angle such that its radially inward-directed axis is projecting toward an opposite end of the leg can for transmitting a substantially axially-directed second force between the tubular jacket leg and the piling which is vectorially opposite the first force.

15. The method as defined in claim 14, further comprising:

each of a third plurality of the multiplicity of piston assemblies being fixed to the leg can such that its radially inward-directed piston axis is projecting on one side of the central axis of the leg can for transmitting a third rotational force between the tubular jacket leg and the piling; and each of a fourth plurality of the multiplicity of piston assemblies being fixed to the leg can such that its radially-directed piston axis is projecting toward an opposite side of the axis of the leg can for transmitting a fourth rotation of force between the tubular jacket leg and the piling opposite the third force.

16. The method as defined in claim 14, further comprising:

removably fixing the axial position of each piston within its piston assembly such that the interconnected arcuately-shaped gripping member is temporarily retained in its retracted position.

17. A method of forming a mechanical connection between a tubular jacket leg of a petroleum recovery platform and a piling to be positioned within the tubular jacket leg and extending into the sea bed, the method comprising:

housing a plurality of radially movable arcuately-shaped gripping members within a portion of the tubular jacket leg;

structurally interconnecting each of the plurality of gripping members and the tubular jacket leg;

moving each of the plurality of gripping members to a radially outward position;

thereafter lowering the platform to the sea bed while retaining the plurality of gripping members in their retracted position;

thereafter passing the piling through the tubular jacket leg and into the sea bed; and thereafter moving each gripping member radially into fixed engagement with the piling within the jacket leg for structurally interconnecting the platform leg and the piling.

18. The method as defined in claim 17, further comprising:

fixedly mounting a plurality of piston assemblies about the tubular jacket leg, each piston assembly being fixed at a predetermined angle with respect to the axis of the tubular jacket leg and structurally interconnecting one of the plurality of gripping members and the tubular jacket leg.

19. The method as defined in claim 17, further comprising:

providing a recess in the portion of the tubular jacket leg housing the plurality of gripping members, the recess having a diameter greater than the nominal diameter of the tubular jacket leg, such that each of the plurality of gripping members may be positioned within the recess when in their retracted position.

20. The method as defined in claim 17, further comprising:

moving each of the gripping members into engagement with the piling in a selected sequence which brings the central axis of the platform leg closer to the central axis of the piling.

21. The method as defined in claim 17, further comprising:

thereafter retracting each gripping member radially outward to a position out of engagement with the piling; and thereafter again moving each gripping member radially inward to a position in re-engagement with the piling.

22. The method as defined in claim 14, further comprising:

severing an upper portion of the piling from the lower portion of the piling;

retracting each gripping member radially outward to a position out of engagement with the piling;

thereafter moving the severed upper portion of the piling axially with respect to the jacket leg to retrieve the piling to the surface; and thereafter retrieving the platform to the surface as a unitary structure.

* * * * *